United States Patent [19]

Lawlor

[11] 4,263,855

[45] Apr. 28, 1981

[54] PALLET

[75] Inventor: James J. Lawlor, Glen Rock, N.J.

[73] Assignee: PDQ Plastics, Inc., Bayonne, N.J.

[21] Appl. No.: 756,367

[22] Filed: Jan. 3, 1977

[51] Int. Cl.[3] ..... B65D 19/24

[52] U.S. Cl. ..... 108/53.3; 108/55.3; 108/901

[58] Field of Search ..... 108/55.3, 53.1, 53.3, 108/51.1, 55.1, 901; 214/10.5 R; 206/503, 505, 511

[56] References Cited

U.S. PATENT DOCUMENTS

| | | | |
|---|---|---|---|
| 2,444,326 | 6/1948 | Baker et al. | 108/55.3 |
| 3,359,929 | 12/1967 | Carlson | 108/53.3 |
| 3,636,888 | 1/1972 | Angelbeck, Jr. | 108/55.3 X |
| 3,702,100 | 11/1972 | Wharton | 108/53.3 |
| 3,762,342 | 10/1973 | Lawlor | 108/53.3 |
| 3,948,190 | 4/1976 | Cook et al. | 108/55.3 X |
| 3,993,168 | 11/1976 | Kubick | 108/55.3 X |

FOREIGN PATENT DOCUMENTS

| | | | |
|---|---|---|---|
| 569349 | 7/1958 | Belgium | 108/51.1 |

*Primary Examiner*—William E. Lyddane

*Attorney, Agent, or Firm*—Norman N. Popper; Daniel H. Bobis

[57] ABSTRACT

A molded, solid, high density, nesting pallet, for barrels or drums, having four-way entry, dimensioned to insure tine positioning of a fork-lift, vertically below the center of gravity of individual barrels or drums, or slightly outboard thereof, and providing a load-bearing surface for a symmetrical load of four barrels or drums on sites surrounded by a raised lip; and pallet legs having indentations positioned to register with flanged tops of barrels or drums upon which a loaded pallet may be stacked.

9 Claims, 6 Drawing Figures

PALLET

BACKGROUND OF INVENTION

1. Field of Invention

This invention relates generally to plastic pallets, and particularly to plastic pallets especially suitable for stacking and for holding palletized barrels and drums by reason of special load-bearing surface configuration.

2. Prior Art

Pallets now in general use are not ordinarily specifically devised to hold drums or barrels, but rather are intended for use to store or transport numerous objects. Drums or barrels when stored or transported on pallets are susceptible to numerous problems. They are inherently unstable on a pallet subjected to varying motions and may slide, or tip and roll off the pallet. Wood pallets are unsuitable because they rapidly deteriorate when acid, oil or other solvents which are normally contained in drums or barrels, spill upon the wood pallet, and they may thereby rapidly deteriorate. In addition, the end boards of wood pallets are particularly susceptible to deterioration, and in use, they may become loose and rip off. Under such circumstances, the barrels or drums stored thereon may tip, and roll off of the pallet and their contents may thereby be spilled and cause very great damage.

Further, wood pallets are normally made in sizes which are not particularly suitable for containing barrels or drums, but are usually in such a size which gives them a certain degree of universality, but not special adaptability. It is recognized that pallets particularly devised for the ordinary or normal drum or barrel should be approximately 48"×48" so that four drums or barrels may be placed thereon without any part of any barrel or drum extending outside the pallet periphery.

If resort is had to plastic pallets, one achieves the desirable attribute of resistance to spills of acids, oils, solvents and other liquid materials ordinarily contained in drums or barrels. But here again, the plastic pallets are not provided in sizes especially adapted for holding or transporting drums and barrels. Having solved the problem of resistance to deterioration by reason of spills, there still remains the problem of constructing such a pallet in the proper size, 48"×48", which will be strong and stable and will not be deformed in carrying heavy loads so that the drums and barrels will roll off the pallet and cause great damage. It is noted that strength, stability, freedom from distortion under heavy loads is especially important since drums and barrels usually have capacity of 55 U.S. gallons, and water weighs 8½ pounds per gallon, and oil may weigh approximately 7½ pounds per gallon. It is therefor recognized that barrels or drums containing fluid or solid materials ordinarily weigh in the neighborhood of 400 to 800 pounds so that a suitable pallet especially devised for storing and transporting barrels and drums must be of great strength, free from the possibility of deforming under load so that tipping of barrels and drums and spilling of contents will not occur. In the use of a plastic pallet particularly devised for the storage of drums or barrels, there is a necessity for a fork lift operator to precisely position the tines of the fork lift so as to be symmetrical with respect to the center of gravity of drums stored on the pallet. Thus, a desirable attribute of a pallet specifically devised for storing and transporting barrels and drums would be a fork entry opening that is so limited in size and position that each blade of a lift truck can only enter under the pallet vertically below the center of gravity of the individual drum loads i.e. the drum centers, or slightly outboard of the drum centers. With such a desirable construction, stability can be achieved. Plastic pallets should have sufficient strength and stability so that drums can be stacked three high. In addition the pallets must be nestable, so that storage space and transportation space required for returning unloaded pallets may be utilized efficiently.

SUMMARY OF INVENTION

It has been found that a pallet made of plastic material can be devised which is tough and durable; highly resistant to deformation under normal load conditions, strong and relatively light in weight. This is accomplished by positioning the formed support legs of the pallet so dimensioned that the target areas for the tines of a fork lift truck are so restricted as to permit only insertion of each tine of the fork lift truck directly below or slightly outboard of the center of gravity of each barrel or drum placed on the pallet. While this construction places a premium upon the precision necessary for the operation of the fork lift, it makes the operation of such a caliber and character that stability of the load is insured. Further it has been found that a pallet for barrels and drums can be devised which provides precise seating areas for barrels and drums placed upon the pallet so that they will be positioned in such a manner that the center of gravity of each drum will be precisely positioned with respect to the fork entry openings of the pallet. This is accomplished by providing the load bearing surface of the pallet with a depressed area, surrounded by a raised area. If the drums are not precisely positioned with respect to the depressed area, they will normally rest upon the surrounding raised area and give visual indication to persons stacking the drums or barrels that they are not in proper position. In order to provide fully adequate load bearing surface without a plain flat top, in accordance with usual practices, a plurality of generally circular surface indentations are arranged concentrically with respect to a central flat area. Between each of the circular surface indentations, there are concentric areas defining generally circular, concentric, load bearing surfaces, so that adequate support is provided for the drums or barrels with a generally depressed area which will serve as a means to properly center the drums in each of the sites of the pallet, by acting as a seat for flange of the barrels or drums.

The bottom of the floor of the legs (floor meaning the lowest external surface of the pallet), is provided with segmentary circular concavities corresponding with the top channel. Thus, when a pallet is stacked on another loaded pallet, there is a precise positioning of the superposed pallet with respect to the underlying pallet by reason of the legs having annular partial channels which precisely engage the flanges of the barrels or drums. In this manner the superposed pallets are positioned in exact registration with the underlying pallets and a stable stack of loaded pallets is achieved, which is not subject to being caused to fall by reason of unstable stacking. In order to prevent jamming of nesting pallets stacking posts are provided to prevent too intimate frictional engagement, and to keep the superposed pallets apart from the underlying pallet.

DRAWINGS

These objects and advantages as well as other objects and advantages are shown by way of illustration in the drawings in which FIG. 1 is a perspective view of the loaded pallet;

PREFERRED EMBODIMENT

Figure 1:
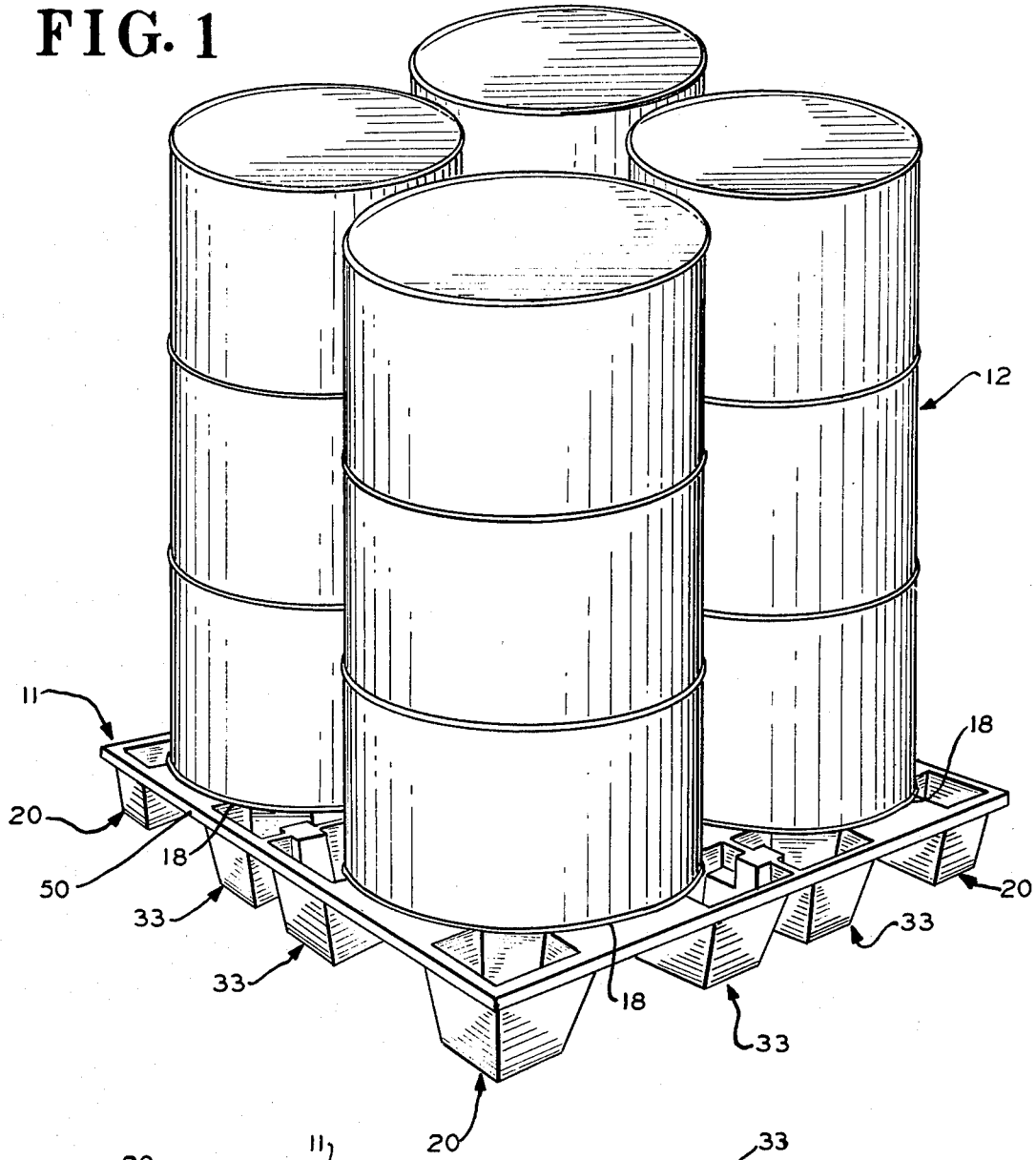
Figure 2:
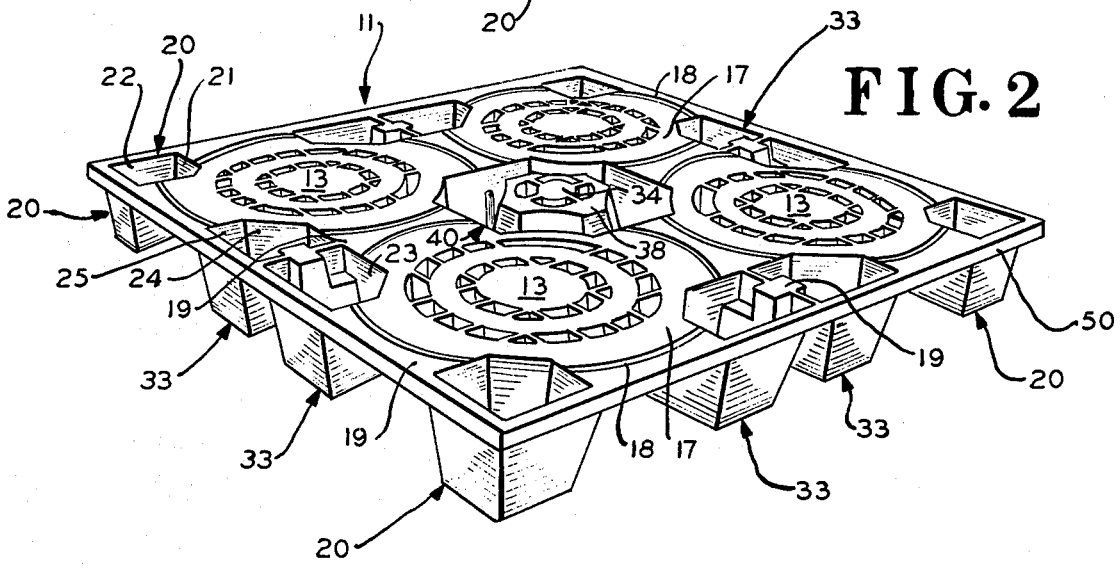
FIG. 2 is a perspective view of the pallet unloaded, showing the load bearing surface, indentations, and positioning channels.
Figure 3:
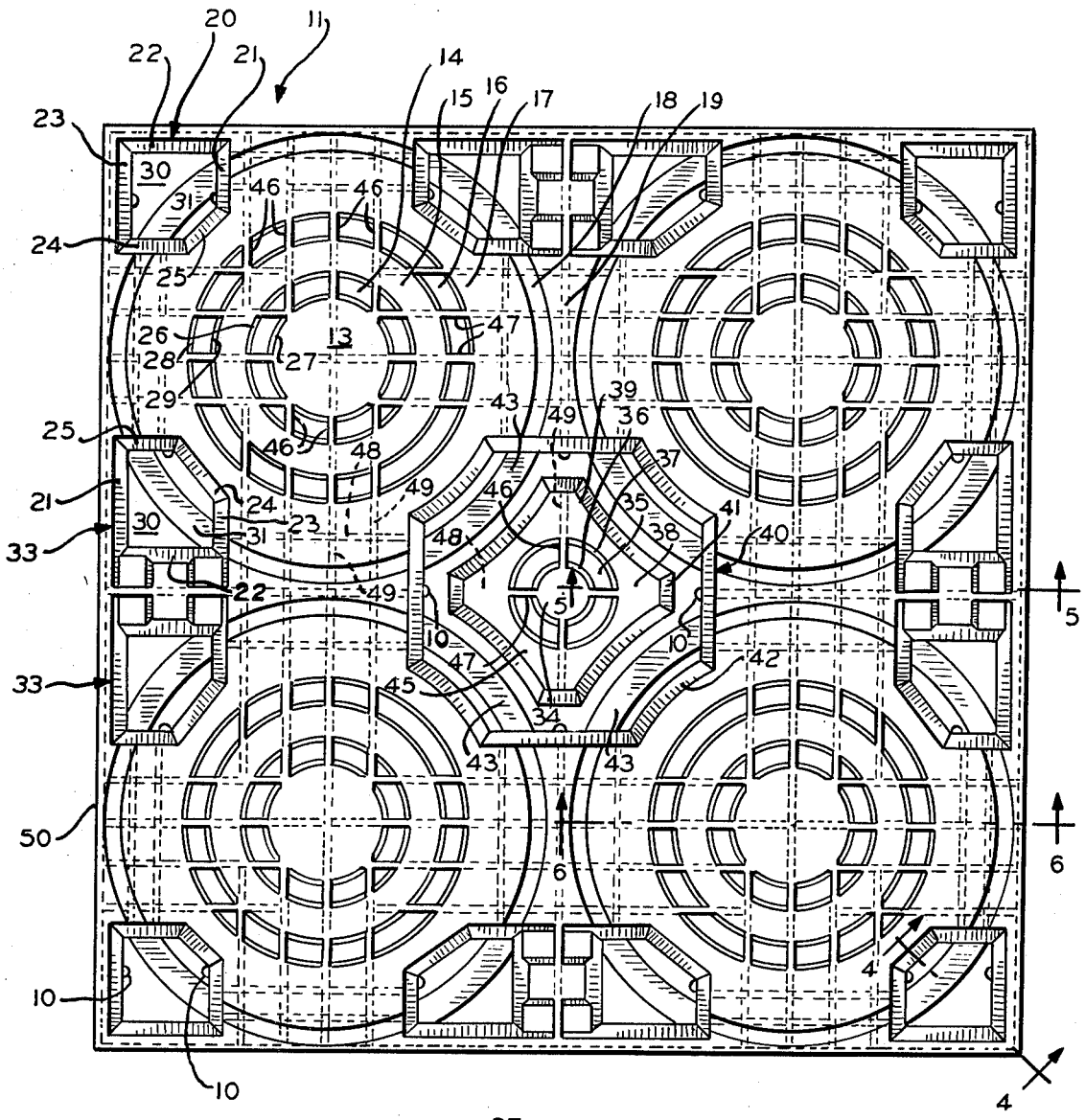
FIG. 3 is a top plan view of the pallet unloaded.

Referring now to the drawings in detail, the present pallet is especially designed for storing, stacking and transporting barrels and drums loaded with liquids. It is made from a sheet 11 which is preferably 48 inches by 48 inches, which dimension is chosen because it can hold four symmetrically spaced barrels or drums 12 on its load bearing surface. The sheet 11 is made of non-expanded, high density polyethylene, although other materials may be chosen. This material is quite suitable because it is strong and rigid; it is highly resistant to combustion originating from spills of combustible liquids. Polypropylene is another suitable material. The sheet is preferably 5/16 inch thick. The sheet provides four sites, 24 inches square on its top load bearing surface. These sites are sufficient to accommodate four drums centered on the sites.

Each of the four sites is provided with a flat, central, inner-area 13. The flat central, inner-area is surrounded by an inner channel 14. The inner channel 14 is in turn surrounded by a flat, annular, intermediate-area 15. The flat, annular, intermediate-area 15 is in turn surrounded by an outer channel 16. The outer channel is surrounded by a flat, outer-area 17. A shallow annular channel 18 is disposed on the flat outer-area, and that shallow annular channel 18 is generally circular in shape and defines a groove dimensioned to receive the flanges on the bottom of a barrel or drum. The placement of the channel 18 in each site is calculated to position the drums or barrels symmetrically on the sites on the sheet 11 so that they will be in a state of equilibrium when the sheet 11 is lifted. Immediately beyond the shallow channel 18, there is a flat area 19 which functions as a retaining rail for the bottom flange of a barrel or drum. The shallow channel 18 serves to position the bottom flange of a barrel or drum on the site concentrically with respect to the flat, central inner area 13. It also serves to position the center of gravity of the barrels or drums 12 in registration with the fork entry openings of the pallet, as will hereinafter be demonstrated.

Figure 4:
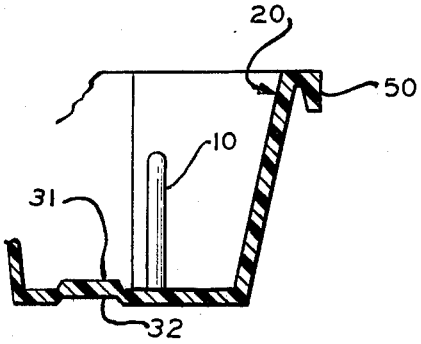
FIG. 4 is a partial cross-sectional view taken on the line 4—4 in FIG. 3, looking in the direction of the arrows.
Figure 5:
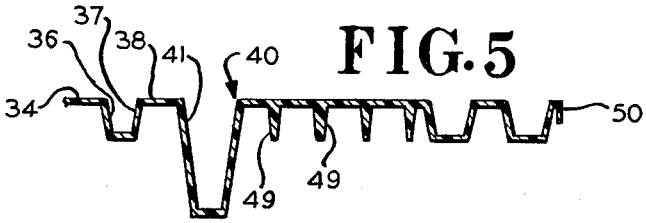
FIG. 5 is a partial cross-sectional view taken on the line 5—5 in FIG. 3, looking in the direction of the arrows.
Figure 6:
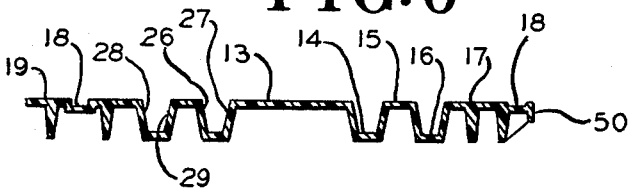
FIG. 6 is a partial cross-sectional view taken on the line 6—6 in FIG. 3, looking in the direction of the arrows.

The preferred, depth of the inner channels 14, and the outer channels 16 may be approximately two inches. The sheet 11 is supported on a plurality of corner legs defined by the walls of leg cavities 20 at each corner. The corner leg cavities 20 are preferably six inches deep. They have five side walls 21, 22, 23, 24, 25 which taper downwardly and inwardly from the surrounding outer area 17 and flat area 19. The inner channels 14, and outer channels 16 also have side walls which taper downwardly and inwardly to permit easy release from the mold cavity in which the pallet is molded. The corner leg cavities 20 each have a floor 30, which is traversed on top by a convex, arcuate rib 31. The opposite, underside of the rib 31 on the leg 20 has a concave arcuate channel 32 (see FIG. 4) corresponding to the rib 31. This concave channel 32 matches in diameter, the top of a barrel or drum. Thus, the sheet 11 can be stacked on top of a load of four barrels or drums 12 on a pallet and the channels 32 will engage the flanges of the underlying four barrels or drums, to provide a secure, multilayer stack.

The four corner-leg cavities 20 do not alone support the sheet 11. Pairs of medial leg-cavities 33 are molded in the sheet 11 at each of the four edges thereof; they are spaced equi-distant from the corner leg-cavities 20. The medial cavities 33 are shaped similar to the corner cavities 20 and have tapered side walls, 21, 22, 23, 24, 25 and a floor 30. The medial cavities also have a convex arcuate rib 31 and a corresponding opposite concave channel (not shown).

Having formed four sites for barrels or drums, and corner 20 as well as medial 33 legs, there remains a middle central area on the sheet 11 to support. There, a middle flat area 34 is provided; it is surrounded by an annular middle channel 35. This channel 35 also has downwardly and inwardly tapered side walls 36, 37 to permit mold release. Surrounding the channel 35 is middle flat area 38 having arcuate concave edges 39. This middle flat area 38 is surrounded by continuous depression in the sheet 11 which defines a central support leg 40. This central support leg 40 is also provided with side walls 41, 42 which taper upward and outward to provide for mold release. The central support leg 40 is provided with arcuate, convex rib segments 43, which have a radius corresponding to the ribs 31 in the legs 20. And like the rib 31, the rib 43 has a corresponding concave channel (not shown) on the underside of the rib 43 in the floor 45 of the central support leg 40.

The load bearing surface of the sheet 11 is defined by the coplanar flat inner area 13, the flat intermediate area 15, the flat outer area 17, the flat area 19, the middle flat central area 34 and the middle flat area 38.

The inner channels 14, the outer channels 16, and the middle channel 35 limit the deformation of sheet 11 under load conditions because each channel is provided with first sets of segmentally continuous bridges 46 extending across the channels in linear fashion, and transverse second sets of bridges 47 extending across the channels perpendicular to the first sets of bridges 46. Under the sheet, segmentally continuous corresponding bridges 49, 48 traverse the sheet. These bridges 46, 47 on top, and bridges underneath 49, 48 are segmentally continuous with each other, thus provide against deformation, since they extend across the sheet and merge with a downturned marginal edge 50.

The corner legs 20 and each medial legs 33 should be spaced apart on all four sides to require precise insertion of the tines of a fork lift to enter under the sheet 11 in close approximate registration (or slightly outboard) with the center of the corresponding sites for barrels and drums, so that the center of gravity of the load on each site is in equilibrium on the tines upon which the sheet 11 rest. In aid of disengagement of pallets that are stacked on top of each other, a number of stacking posts 10 are provided in each of the legs. In this manner, a superposed pallet will be held from tight stacked engagement with an underlying pallet.

The stacking posts 10 are provided in twenty positions to provide non-jamming, nesting of pallets with a 2" clearance between pallets.

What is claimed:

1. A pallet for barrels and drums comprising,
(a) a rigid, rectangular, molded plastic sheet,
(b) four, generally coequal sites on the top of the sheet defining a load bearing surface,
(c) each site comprising,
(A) a flat central generally circular inner area,
(B) an inner generally annular, bridged channel surrounding the central area,
(C) a flat intermediate generally circular area surrounding the inner channel,
(D) an outer generally annular, bridged channel surrounding the flat intermediate area,
(E) a flat outer area, surrounding the outer channel,
(F) a shallow annular channel disposed on the flat outer area, and defining a groove for a flange on the bottom of a barrel or drum,
(G) a flat area defining a retaining rail for the bottom flange of a barrel or drum, surrounding portions of the shallow annular channel.

2. A pallet for barrels and drums comprising,
(a) the device according to claim 1,
(b) depressions at each corner of the sheet defining corner legs to support the load bearing surfaces,
(c) depressions on the sheet spaced inwardly generally equidistant from the corner legs, and defining intermediate support-legs.

3. A pallet for barrels and drums comprising,
(a) the device according to claim 2,
(b) a middle, flat central area at the intersection of the four generally coequal sites on the top of the sheet,
(c) a middle channel surrounding the middle flat central area,
(d) a middle flat, intermediate, area surrounding the middle channel,
(e) a continuous depression in the sheet surrounding the flat intermediate middle area defining a central support-leg.

4. A pallet for barrels and drums comprising,
(a) the device according to claim 3,
(b) the flat central area, the flat intermediate area, the flat outer area, the flat area defining a retaining rail, the middle flat central area, the middle flat intermediate area, all being generally coplanar with each other and together comprising a load bearing surface.

5. A pallet for barrels and drums comprising,
(a) the device according to claim 2,
(b) each of the spaces between each corner leg to each, intermediate support-leg being sufficiently narrow to closely receive a tine of a fork lift.

6. A pallet for barrels and drums comprising,
(a) the device according to claim 5,
(b) a center line of each site being in general registration with the center of the corresponding space between the adjacent corner leg and adjacent medial leg, whereby the center of gravity of a load on each site is in equilibrium with a tine of a fork lift intruded between a corner leg and an adjacent medial leg.

7. A pallet for barrels and drums comprising,
(a) the device according to claim 2,
(b) each leg having a floor,
(c) a stacking channel in the bottom of each leg in general registration with the flat annular channel whereby a pallet may be stacked on a loaded pallet with the stacking channel engaged with the rim of the barrels and drums loaded on another pallet.

8. A pallet for barrels and drums comprising,
(a) a generally rectangular sheet,
(b) a flat central generally circular inner area,
(c) an inner generally annular, bridged channel surrounding the flat central area,
(d) a flat intermediate generally circular area surrounding the inner channel,
(e) an outer generally annular, bridged channel surrounding the flat intermediate area,
(f) a flat outer area surrounding the outer channel,
(g) a flat shallow annular channel on a portion of the flat outer area, and defining a seat for portion of a flange on the bottom of a barrel or drum,
(h) a flat outer area surrounding a portion of the flat annular shallow channel defining a retaining lip to position the bottom flange of a barrel or drum concentrically with respect to the flat central inner area.

9. A pallet for barrels and drums comprising,
(a) a generally flat, rigid rectangular molded plastic deck,
(b) the deck divided into four sites,
(c) a pair of concentric annular channels in each site,
(d) integral bridges across each of the concentric annular channels dividing the channels into discontinuous arcuate segments; to strengthen the sheet against deformation for its full extent, from both ends to the other opposite ends,
(e) shallow annular grooves concentric with each pair of annular channels on each site and having a diameter greater than each pair of channels, and dimensioned to receive the flange on the bottom of a barrel or drum,
(f) a plurality of depressions in the plastic deck, deeper than the pairs of channels and defining legs to support the deck,
(g) an annular channel in the deck at the center thereof at the intersection of the sites,
(h) integral bridges in the deck across the annular channel at the center of the deck,
(i) a depression at the center of the deck, surrounding the annular channel at the center of the deck, deeper than the central annular channel and defining a central leg,
(j) the plurality of depressions, defining legs positioned:
(A) one at each corner of the deck, and
(B) at the edges of the deck, in pairs, spaced away from the legs at each corner, and
(C) the spaces between the corner legs and the adjacent legs of each pair being sufficient to admit the tines of a fork lift at any of the four sides of the deck.

* * * * *